US009941596B2

(12) United States Patent
Zhang et al.

(10) Patent No.: US 9,941,596 B2
(45) Date of Patent: Apr. 10, 2018

(54) DUAL-POLARIZED FILTERING ANTENNA WITH HIGH SELECTIVITY AND LOW CROSS POLARIZATION

(71) Applicant: South China University of Technology, Guangzhou, Guangdong (CN)

(72) Inventors: Xiu Yin Zhang, Guangdong (CN); Wen Duan, Guangdong (CN); Yong-Mei Pan, Guangdong (CN)

(73) Assignee: South China University of Technology, Guangzhou (CN)

( * ) Notice: Subject to any disclaimer, the term of this patent is extended or adjusted under 35 U.S.C. 154(b) by 0 days.

(21) Appl. No.: 15/173,597

(22) Filed: Jun. 3, 2016

(65) Prior Publication Data

US 2017/0294717 A1 Oct. 12, 2017

(51) Int. Cl.

| | |
|---|---|
| ***H01Q 1/38*** | (2006.01) |
| ***H01Q 19/00*** | (2006.01) |
| ***H01Q 9/04*** | (2006.01) |

(52) U.S. Cl.

CPC ..... *H01Q 19/005* (2013.01); *H01Q 9/0414* (2013.01); *H01Q 9/0457* (2013.01); *H01Q 9/0478* (2013.01)

(58) Field of Classification Search

CPC .. H01Q 19/005; H01Q 9/0414; H01Q 9/0457; H01Q 9/0478

USPC ..... 343/700 MS

See application file for complete search history.

(56) References Cited

U.S. PATENT DOCUMENTS

2013/0063310 A1* 3/2013 Mak ..... H01Q 1/246 343/700 MS

* cited by examiner

*Primary Examiner* — Graham Smith

(57) ABSTRACT

A dual-polarized filtering antenna comprising a driven patch, a parasitic stacked patch and a feeding network is disclosed. Two orthogonal H-shaped feeding lines are coupled to the driven patch for realizing dual polarization. The H-shaped feeding line provides a sharp roll-off rate at the lower band-edge, whereas the stacked patch offers a radiation null at the upper stopband. As a result, a quasi-elliptic bandpass response can be achieved for both polarizations.

19 Claims, 11 Drawing Sheets

CO-P (measured)
CROSS-P (measured)
CO-P (simulated)
CROSS-P (simulated)

CO-P (measured)
CROSS-P (measured)
CO-P (simulated)
CROSS-P (simulated)

DUAL-POLARIZED FILTERING ANTENNA WITH HIGH SELECTIVITY AND LOW CROSS POLARIZATION

CROSS-REFERENCE TO RELATED APPLICATIONS

The present disclosure claims the benefit of Chinese Patent Application No. 201610209989.6, filed on Apr. 6, 2016, the contents of which are hereby incorporated by reference.

TECHNICAL FIELD

The present disclosure relates generally to a filtering antenna, and more particularly, to a dual-polarized filtering antenna with high selectivity and low cross polarization.

BACKGROUND

With the development of mobile communications, multi-band antennas are required to simultaneously support the multi-band and multi-standard wireless systems such as 2G, 3G and 4G. On the other hand, dual polarization is necessary for base station antenna arrays. Therefore, multi-band dual-polarized antenna arrays are demanded in these systems. In multi-band array designs, it is common to use separated antenna elements which operates at different frequency bands. Mutual coupling between the elements becomes a problematic issue, especially when the two frequency bands are close to each other. Although increasing the separation of antenna elements can reduce mutual coupling, the array becomes bulky. Instead, if the out-of-band radiation of the antenna elements can be suppressed, then the mutual coupling can be reduced effectively. This is to say, the antenna elements with filtering behavior are desirable.

Recently, much work on filtering antennas was conducted. In these designs on filtering antenna, it was popular to cascade filtering circuits and antennas. In this way, the last-stage resonator of the filter was replaced by an antenna radiator. Extra impedance transformers were employed between the filter and antenna or optimized impedance was chosen at the interface between them. Satisfying performance has been reported, however the multiple resonators usually occupied large area. The size can be reduced by using defected ground plane and 3-D configurations that putting cavity resonators under the radiators. Besides, compact designs can also be obtained by integrating a filtering power divider or balun filter into antenna feeding networks.

In the above designs, the filtering antenna was realized by integrating extra filtering circuits to the antenna feeding networks. Therefore, insertion loss caused by the extra filtering circuits was inescapable, resulting in lower antenna gain or efficiency. To avoid the problem, a filtering printed unidirectional loop antenna was realized by adding a parasitic loop, and a stacked patch filtering antenna was achieved by using shorting vias and U-slot. Since no particular filtering circuits were involved, the antenna performances were not affected. However, both designs are singly-polarized, and their structures are not easy to be extended for dual polarizations.

Therefore, a heretofore unaddressed need exists in the art to address the aforementioned deficiencies and inadequacies.

SUMMARY

In one aspect, the present invention relates to a dual-polarized filtering antenna comprising a driven patch, a parasitic stacked patch and a feeding network, wherein the parasitic stacked patch is fabricated on a top face of a first substrate, the driven patch and the feeding network are fabricated on top and bottom faces of a second substrate, respectively; wherein the feeding network comprises a first H-shaped feeding line and a second H-shaped feeding line which are orthogonal, wherein the parasitic stacked patch and the driven patch are excited by the first H-shaped feeding line and the second H-shaped feeding line, each for one polarization.

In one embodiment, a radiation null in a lower band can be realized by the first H-shaped feeding line and the second H-shaped feeding line, and another radiation null in an upper band is obtained by the stacked patch.

In one embodiment, without extra filtering circuit, good bandpass filtering response in a gain curve can be obtained by two radiation nulls realized by the first H-shaped feeding line and the second H-shaped feeding line and by the stacked patch, respectively.

In one embodiment, a frequency of the radiation null generated by the first H-shaped feeding line and the second H-shaped feeding line can be controlled by adjusting a size of the first H-shaped feeding line and the second H-shaped feeding line.

In one embodiment, an equivalent length of the H-shape feeding line is about half of a wavelength at a frequency of the radiation null in the lower band.

In one embodiment, a frequency of the radiation null generated by the stacked patch can be controlled by adjusting a size of the stacked patch.

In one embodiment, the first H-shaped feeding line and the second H-shaped feeding line are designed as a stepped-impedance line with different widths for better impedance matching.

In one embodiment, a structure of this dual-polarized filtering antenna is designed symmetrically, a better cross-polarization can be obtained.

In one embodiment, an air gap is introduced between the first and second substrates for enhancing antenna bandwidth and gain.

In one embodiment, a first probe and a second probe of the first H-shaped feeding line and the second H-shaped feeding line are fed by an inner conductor of SMA connectors at a distance from a center of the first H-shaped feeding line, and a distance from the center of the second H-shaped feeding line, respectively.

In one embodiment, the impedance matching can be adjusted by changing the distance between the center of the first H-shaped feeding line and the first probe, and the distance between the center of the second H-shaped feeding line and the second probe.

In one embodiment, the center of the second H-shaped feeding line for the second probe is set on the top face of the second substrate, and connected remaining parts of the second H-shaped feeding line via two metallic via holes, the remaining parts of the second H-shaped feeding line is on the bottom face of the second substrate.

In one embodiment, a ring slot is etched to separate the center part of the second H-shaped feeding line and the driven patch.

In one embodiment, the driven patch, the first H-shaped feeding line and the second H-shaped feeding line are printed on the same substrate, which help to reduce the cost and size of the antenna.

In a further aspect, the present invention relates to a dual-polarized filtering antenna comprising a driven patch, a parasitic stacked patch and a feeding network, wherein the parasitic stacked patch is fabricated on a top face of a first substrate, the driven patch and the feeding network are fabricated on top and bottom faces of a second substrate, respectively, an air gap is introduced between the first and second substrates for enhancing antenna bandwidth and gain, the feeding network comprises a first H-shaped transmission line and a second H-shaped transmission line which are orthogonal, wherein the parasitic stacked patch and the driven patch are excited by the first H-shaped transmission line and the second H-shaped transmission line, each for one polarization; wherein the first H-shaped transmission line and the second H-shaped transmission line are designed as a stepped-impedance line with different widths for better impedance matching, a center part of the second H-shaped transmission line for the second probe is set on a top face of the second substrate, and connected remaining parts of the second H-shaped transmission line via two metallic via holes, the remaining parts of the second H-shaped transmission line is on the bottom face of the second substrate; a square ground plane with a size of one wavelength is used for directional radiation of the dual-polarized filtering antenna.

In one embodiment, a ring slot is etched to separate the center part of the second H-shaped feeding line and the driven patch.

In one embodiment, a first probe and a second probe of the first H-shaped transmission line and the second H-shaped transmission line are fed by an inner conductor of SMA connectors at a distance from a center of the first H-shaped feeding line, and a distance from the center of the second H-shaped feeding line, respectively.

In yet anther aspect, the present invention relates to a dual-polarized filtering antenna comprising a driven patch, a parasitic stacked patch and a feeding network, wherein the parasitic stacked patch is fabricated on a top face of a first substrate, the driven patch and the feeding network are fabricated on top and bottom faces of a second substrate, respectively; an air gap is introduced between the first and second substrates for enhancing antenna bandwidth and gain; the feeding network comprises a first H-shaped feeding line and a second H-shaped feeding line which are orthogonal, wherein the parasitic stacked patch and the driven patch are excited by the first H-shaped feeding line and the second H-shaped feeding line, each for one polarization, wherein the first H-shaped feeding line and the second H-shaped feeding line are designed as a stepped-impedance line with different widths for better impedance matching, a center part of the second H-shaped feeding line for the second probe is set on a top face of the second substrate, and connected remaining parts of the second H-shaped feeding line via two metallic via holes In one embodiment, a ring slot is etched to separate the center part of the second H-shaped feeding line and the driven patch.

In one embodiment, a first probe and a second probe of the first H-shaped transmission line and the second H-shaped transmission line are fed by an inner conductor of SMA connectors at a distance from a center of the first H-shaped feeding line, and a distance from the center of the second H-shaped feeding line, respectively.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE PREFERRED EMBODIMENT

Figure 1:
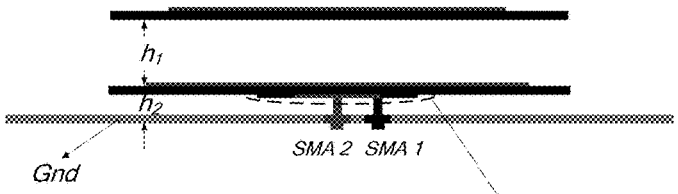
FIGS. 1 (*a*)-(*d*) show a configuration diagram of a dual-polarized filtering antenna according to one embodiment of the present application.
Figure 1:
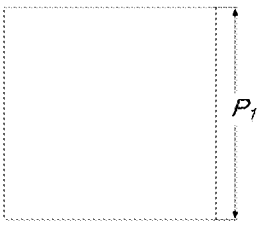
Figure 1:
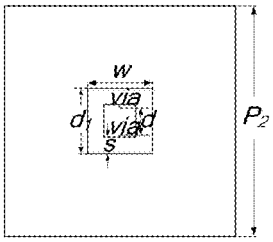
Figure 1:
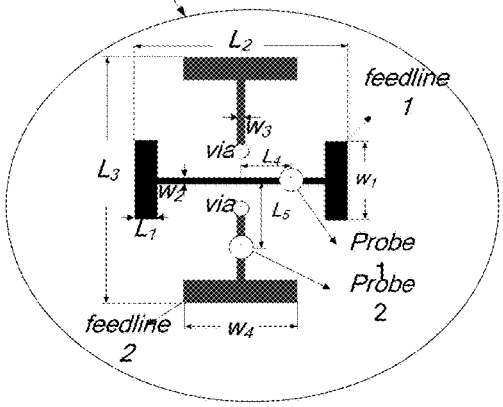

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views.

As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, "around", "about" or "approximate" shall generally mean within 20 percent, preferably within 10 percent, and more preferably within 5 percent of a given value or range. Numerical quantities given herein are approximate, meaning that the term "around", "about" or "approximate" can be inferred if not expressly stated.

As used herein, the terms "comprising," "including," "having," "containing," "involving," and the like are to be understood to be open-ended, i.e., to mean including but not limited to.

The description will be made as to the embodiments of the present invention in conjunction with the accompanying drawings in FIGS. 1-15. In accordance with the purposes of this disclosure, as embodied and broadly described herein, this disclosure, in one aspect, relates to a dual-polarized filtering antenna.

Referring now to FIGS. 1(*a*)-(*d*), a dual-polarized filtering antenna is shown according to one embodiment of the present invention. The dual-polarized filtering antenna comprises a driven patch (FIG. 1(*c*)), a parasitic stacked patch (FIG. 1(*b*)) and a feeding network (FIG. 1(*d*)). As shown in FIG. 1(*b*)-(*d*), the square parasitic stacked patch with a sidelength of $p_1$ is fabricated on top face of the first substrate, whereas the driven patch with sidelength of $p_2$ and the feeding network are fabricated on the top and bottom faces of the second substrate, respectively. Both the first and second substrates have an approximate permittivity of $\epsilon_r$=2.65, an approximate thickness of t=1 mm and an approximate size of L×L. An air gap with height of $h_1$ is introduced between the two substrates for enhancing the antenna bandwidth and gain. As shown in FIG. 1(*d*), the feeding network comprises a first H-shaped feeding line (line 1) and a second H-shaped feeding line (line 2) which are orthogonal. The square parasitic stacked patch and the driven patch are excited by the two orthogonal H-shaped feeding lines, each for one polarization. The specific H-shaped feeding line is designed as a stepped-impedance line with different widths ($w_1$, $w_2$ for Probe 1, and $w_3$, $w_4$ for Probe 2). Probes 1 and 2 are fed by the inner conductor of SMA connectors at the distance of $L_4$ and $L_5$ from the center, respectively. To avoid intersection of the two orthogonal H-shaped feeding lines, the center part of the H-shaped feeding line for probe 2 is set on top face of the second substrate. It is connected with the remaining parts through two metallic via holes. This avoids the use of extra air bridge and is easy for fabrication. Also, the isolation between two probes can be enhanced. Since the center part of the second H-shaped feeding line for probe 2 is on the same layer with the driven patch, a ring slot with width s is etched to separate them, as shown in FIGS. 1 (*a*)-(*d*). A square ground plane with a side length of G is used for the dual-polarized filtering antenna. It is located below the second substrate at a distance of $h_2$. The detailed approximate dimensions of the proposed dual-polarized filtering antenna are listed in Table I. Of course, one skilled in the art can adjust the following values based on actual design requirement, fabrication environments and so on. The following values listed are not intend to limit present application, but for illustration.

TABLE I

DIMENSIONS OF THE PROPOSED ANTENNA

| Parameter | $h_1$ | $h_2$ | G | $p_1$ | $p_2$ | L | w |
|---|---|---|---|---|---|---|---|
| Value (mm) | 7 | 1 | 120 | 40 | 42.5 | 60 | 8.3 |
| Parameter | $d_1$ | s | $w_1$ | $w_2$ | $w_3$ | $w_4$ | $L_1$ |
| Value (mm) | 8.3 | 2.3 | 7 | 0.2 | 0.5 | 10 | 2 |
| Parameter | $L_2$ | $L_3$ | $L_4$ | $L_5$ | d | t | |
| Value (mm) | 16 | 18 | 4.5 | 6 | 5 | 1 | |

The proposed dual-polarized filtering antenna according to present application is basically composed of a simple feeding network, a driven patch and a stacked patch. Two orthogonal H-shaped feeding lines are coupled to the driven patch for realizing dual polarization. The H-shaped feeding line provides a sharp roll-off rate at the lower band-edge, whereas the stacked patch offers a radiation null at the upper stopband. As a result, a quasi-elliptic bandpass response can be achieved for both polarizations.

In order to explain the principles and validate the effect of present application, the antenna mechanism is detailed. Simulated and measured results are presented as well.

Figure 2:
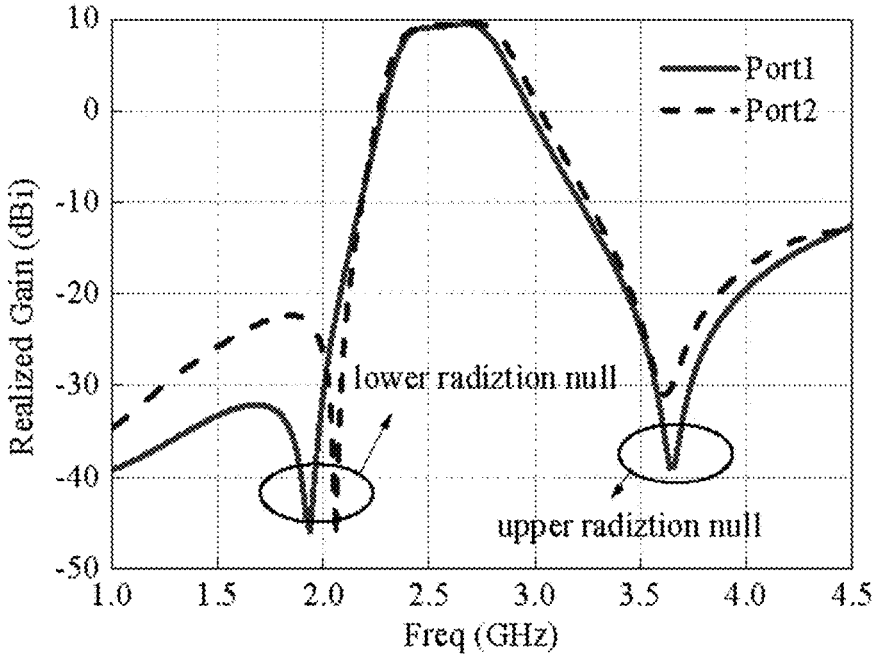
FIG. 2 shows a realized boresight gain of the dual-polarized filtering antenna shown in FIG. 1.

Referring now to FIG. 2, the proposed dual-polarized filtering antenna can generate a quasi-elliptic bandpass response with two radiation nulls for each polarization. The mechanism is addressed in detail below.

Firstly, the operating principle for realizing bandpass responses is studied based on filter theory. The configuration of the proposed dual-polarized filtering antenna is similar to that of a filter, with the corresponding circuit shown in FIG. 3. It consists of a feeding line, two resonators and a radiation resistor. The feeding line is composed of a narrow high-impedance feeding line (TL) and two wide low-impedance ones that are near the open ends.

Figure 4:
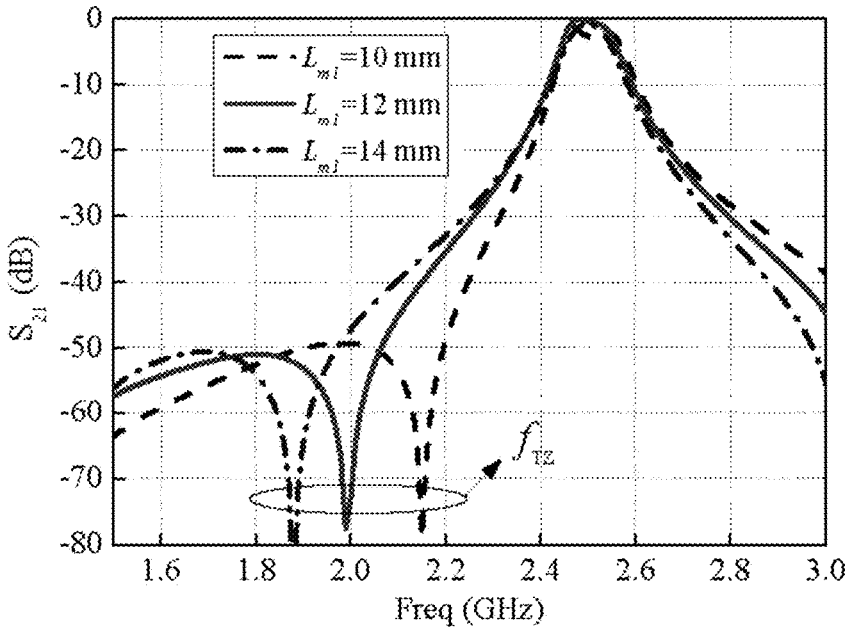
FIG. 4 shows a simulated transmission coefficient of the equivalent network for three different lengths $L_{m1}$.

An input port (Port 1) is connected to the high-impedance line and split it into two parts with lengths of $L_{m1}$ and $L_{m2}$. Two resonators together with the radiation resistor are used to replace two patches in the antenna. In order to explore the transmission characteristics, Port 2 is used to take place of the radiation resistor, and the whole circuit can be regarded as a second-order bandpass filter. FIG. 4 shows the simulated transmission coefficient $S_{21}$. It can be observed that a bandpass response is obtained, and there is a transmission zero at the lower stopband, which helps improving the out-of-band rejection levels.

Figure 3:
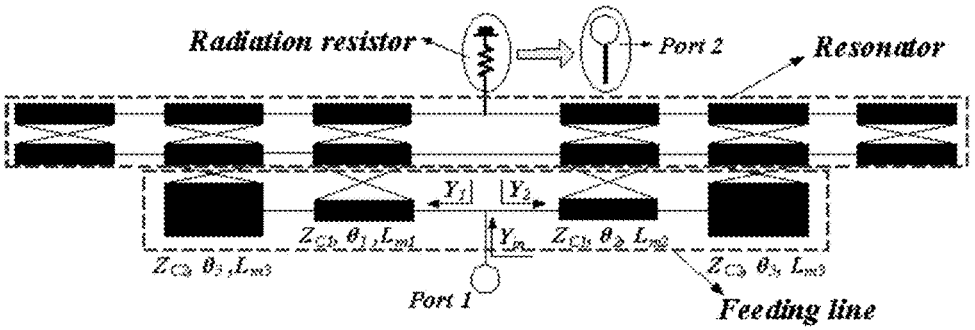
FIG. 3 shows a corresponding two-probe network of the dual-polarized filtering antenna shown in FIG. 1.

To investigate the above-mentioned transmission zero, the input impedance of the feeding lines is deduced. As shown in FIG. 3, the input admittance of the feeding line on the left side of port 1 is defined as $Y_1$. Because the transmission zero is out of the passband, the coupling between the feeding line and the resonators is relatively weak at this frequency and is ignored for simplicity. In this case, $Y_1$ can be calculated as:

$$Y_1 = \frac{Z_{c1} + Z_{c2}\cot\theta_3\tan\theta_1}{Z_{c1}(-jZ_{c2}\cot\theta_3 + jZ_{c1}\tan\theta_1)} \quad (1)$$

where θ=βL denotes the electric length of the feeding line. Similarly, the input admittance on the right side of port 1 $Y_2$ can be represented as:

$$Y_2 = \frac{Z_{c1} + Z_{c2}\cot\theta_3\tan\theta_2}{Z_{c1}(-jZ_{c2}\cot\theta_3 + jZ_{c1}\tan\theta_2)} \quad (2)$$

Therefore, the total input admittance $Y_{in}$ is given by:

$$Y_{in}=Y_1+Y_2 \quad (3)$$

Figure 5:
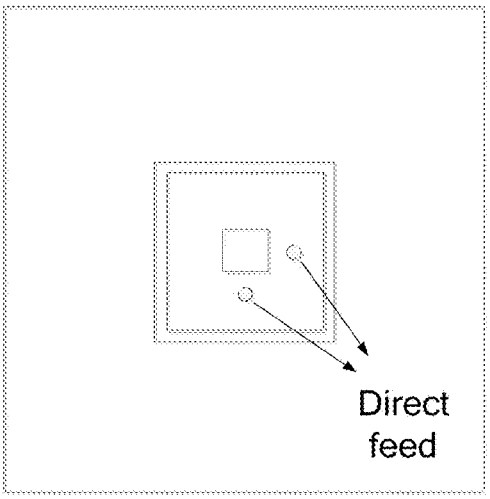
FIG. 5 (*a*) and FIG. 5 (*b*) show antennas with direct feed and the coupling feed according to present application, respectively.
Figure 5:
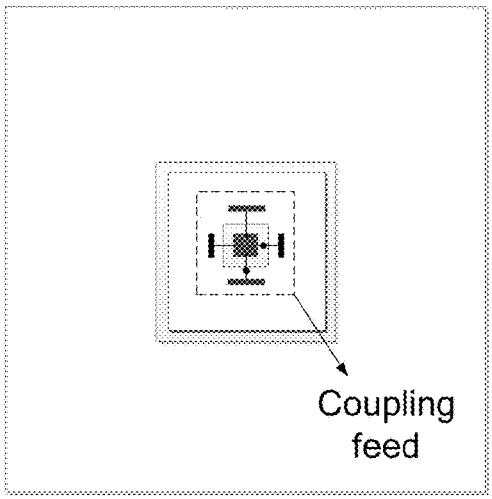
Figure 6:
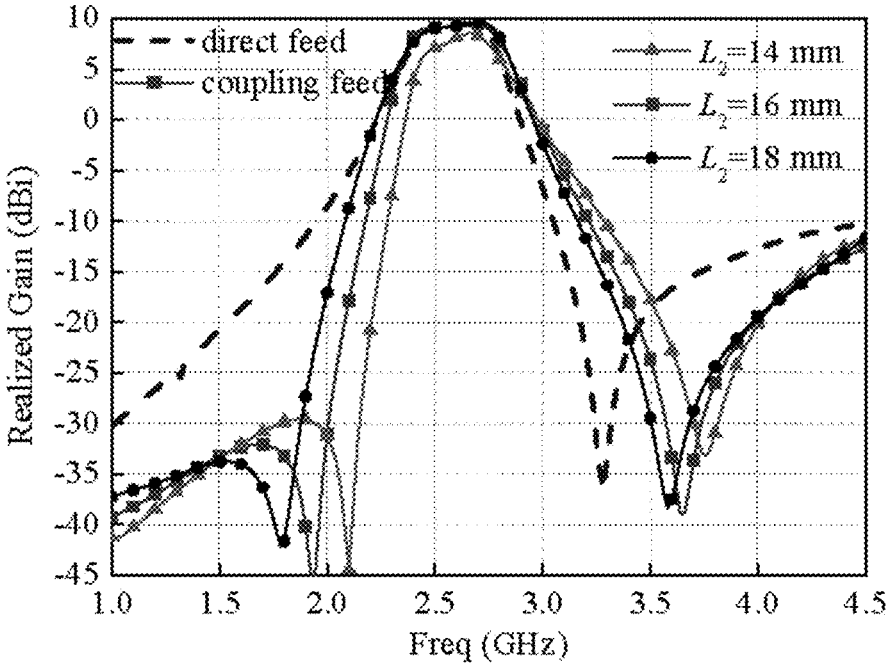
FIG. 6 shows the simulated gain curves for the two different feeding structures shown in FIG. 5.
Figure 7:
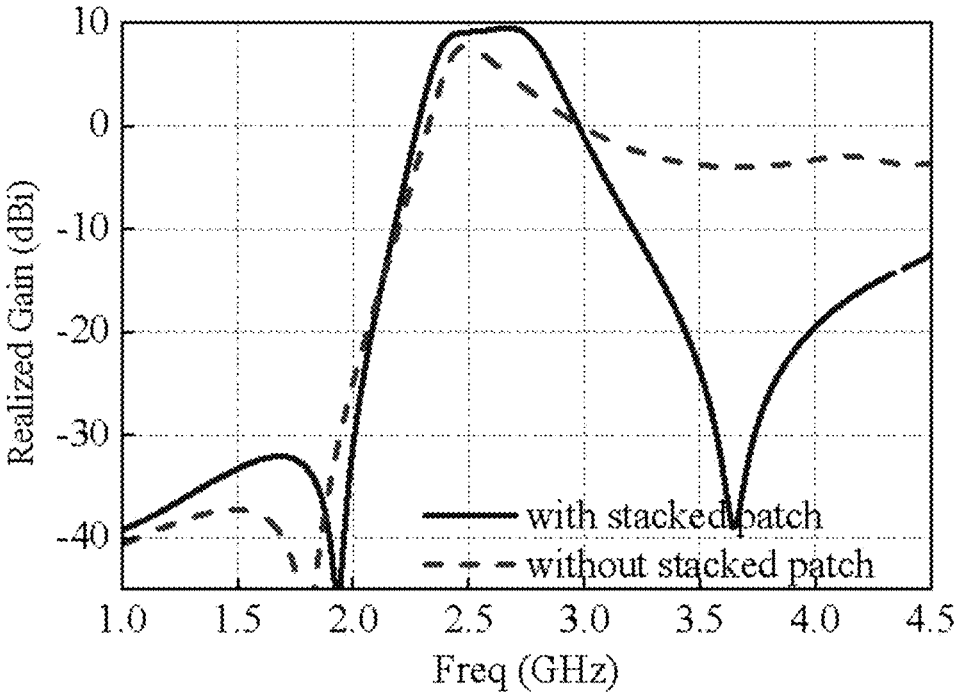
FIG. 7 shows the realized gain of a single patch antenna and stacked patch antenna at the boresight direction.

When $Y_{in}=\infty$, the magnitude of reflection coefficient of Port 1 equals to 1 ($|\Gamma_{in}=1|$), which means the incident signal is completely reflected and blocked by the feeding network. Thus, a transmission zero at $f_{TZ}$ can be generated. According to equations (1)-(3), $f_{TZ}$ is directly related to the lengths of TLs. Therefore, it should be able to control the position of $f_{TZ}$ by altering the lengths of feeding lines. For verification, simulations are carried out with different lengths $L_{m1}$, and the results are also shown in FIG. 4. It is observed that $f_{TZ}$ changes significantly with $L_{m1}$ as expected. Based on the above analysis, it can be inferred that the radiation null at the lower band edge of the proposed dual-polarized filtering antenna is realized by the elaborately designed feeding line. For further verification, antennas with direct feed and the proposed feed scheme are compared. FIG. 5 (*a*) and FIG. 5 (*b*) show antennas with direct feed and the coupling feed according to present application, respectively, and FIG. 6 shows the simulated realized gain at boresight direction of the two antennas. It can be seen that a radiation null at 1.9 GHz is realized by using the proposed feed circuit, whereas it disappears when the direct feed configuration is used. Also, it can be clearly seen that the frequency of the radiation null can be adjusted by changing the length of feeding line. The responses are similar to those shown in FIG. 4, verifying again the effectivity and flexibility of the proposed H-shaped feeding line. Moreover, it should be mentioned that the introduction of feeding line nearly has no impact on the flat gain within the passband, which is very desirable. The radiation null in the upper stopband has also been investigated. The patch antennas with and without the stacked patch are compared for validation. FIG. 7 shows the simulated gain for the two antennas. As can be seen, the inserting of the stacked patch not only can enhance the impedance bandwidth and antenna gain, but also can provide a radiation null which is essential to the good filtering performance in the upper stop band.

A parametric study was carried out using HFSS to further characterize the proposed dual-polarized filtering antenna.

Figure 8:
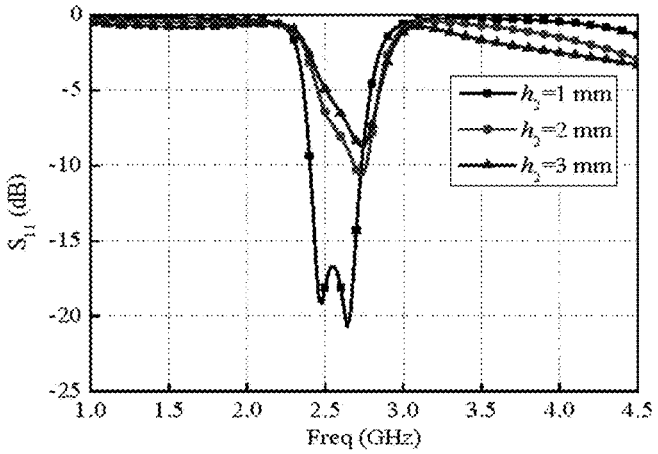
FIGS. 8 (*a*)-(*c*) show the effect of the distance between the feed network and ground on (a) reflection coefficients; (b) gain; (c) isolation, respectively.
Figure 8:
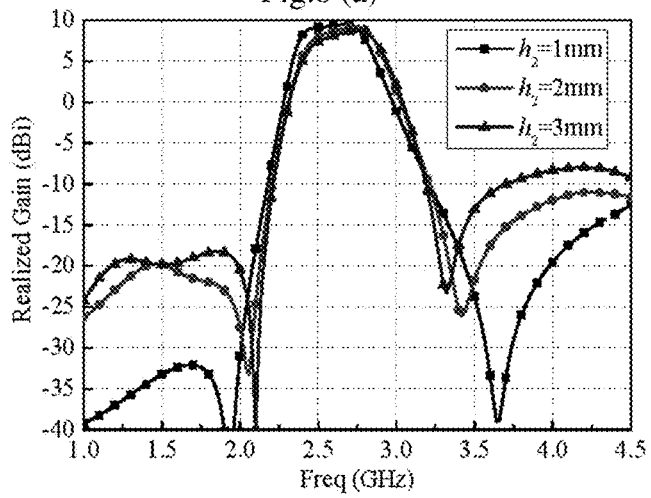
Figure 8:
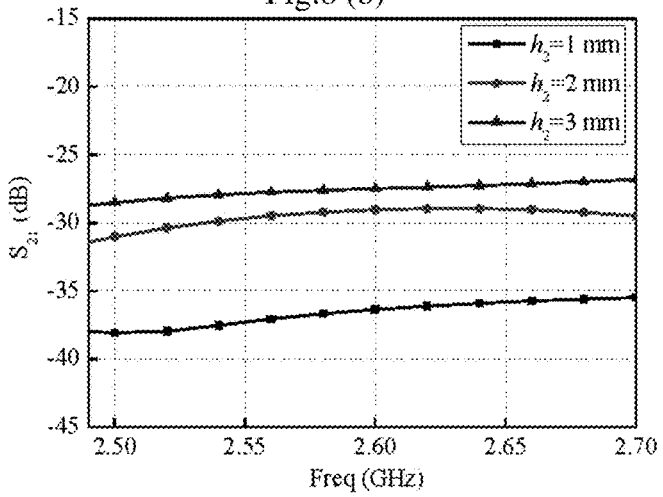

The effect of the distance ($h_2$) between the driven patch and ground is investigated firstly. FIGS. 8(*a*)-(*c*) show the simulated reflection coefficient, antenna gain and isolation as a function of frequency for $h_2$=1, 2 and 3 mm. It can be seen from FIG. 8 (*a*) that $h_2$ affects significantly the reflection coefficient in both the passband and stopband. This is reasonable because it partially determines the input impedance of the antenna. Consequently, the out-of-band rejection changes significantly when $h_2$ increases from 1 to 3 mm, as shown in FIG. 8 (*b*). The distance also affects the mutual coupling between two ports considerably. With reference to FIG. 8 (*c*), a smaller $h_2$ is good for high isolation. This is because of that the higher h2 will lead to a stronger cross-polarization radiation which has considerably an impact on the mutual coupling between two ports.

Figure 9:
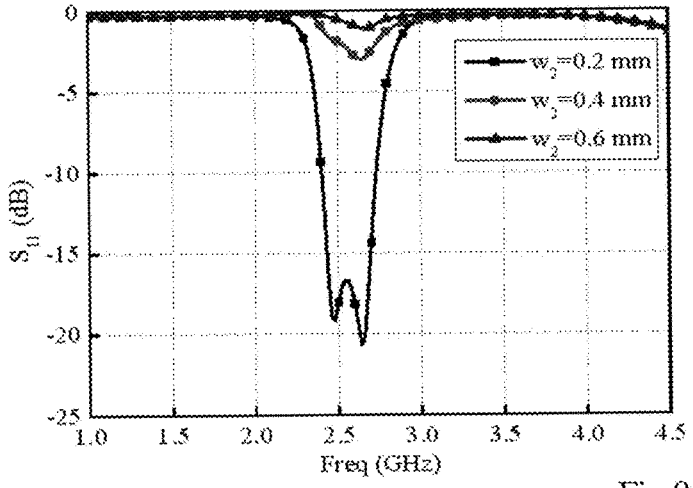
FIGS. 9 (*a*)-(*c*) show the effect of the feeding line width on (a) reflection coefficients; (b) gain; (c) isolation.
Figure 9:
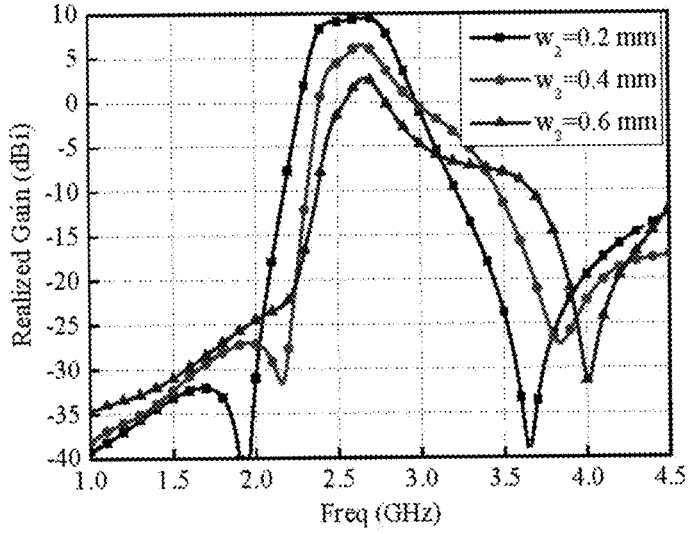
Figure 9:
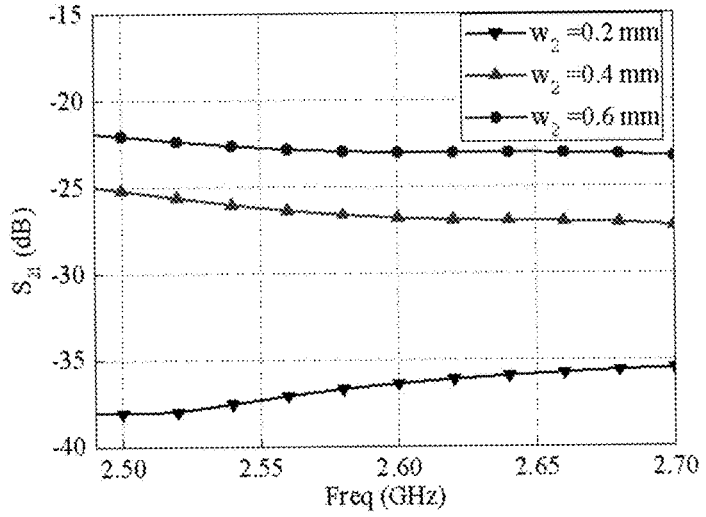

Then, the effect of the H-shaped feeding line is investigated. FIGS. 9(*a*)-(*c*) show the results for different widths $w_2$ of the high-impedance feeding line. It can be seen from FIG. 9 (*a*) that the width has strong impact on the reflection coefficients, which is as expected since $w_2$ is directly related to the coupling between the feeding line and driven patch. As shown in FIG. 9 (*b*), the gain within passband drops quickly when the antenna matching turns bad, as expected. Moreover, the radiation null shifts upward with the increasing of $w_2$. This can be explained by using equation (1)-(3) given in previous section. With reference to FIG. 9 (*c*), narrower feeding line with smaller $w_2$ provides better isolation, which is due to that narrower feeding line induces weaker impact on the mutual coupling between two orthogonal feeding lines. Considering the fabrication limit, $w_2$=0.2 mm is chosen for the final design.

The effects of the parameters $w_1$ and $L_1$ have also been studied. It was found that the variation of impedance matching and gain curve are similar to those of $w_2$ and $L_2$. So the results are not shown here for brevity. The parameters of the feeding line for Port 2 have also been studied. The results are almost the same as those of Port 1. One skilled in the art knows, besides the values listed in table I, other possible values can be selected after related calculation and testing.

Figure 10:
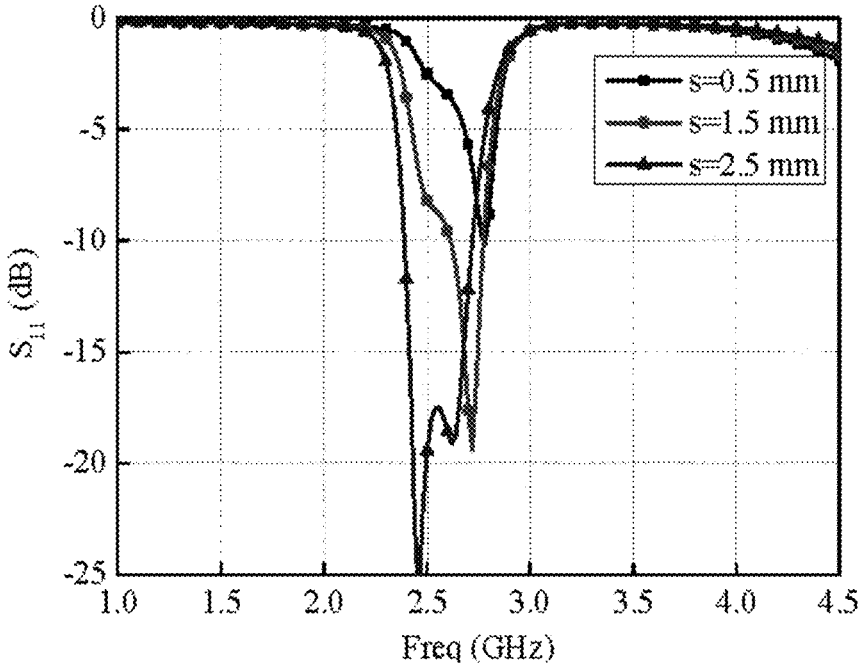
FIGS. 10 (*a*)-(*b*) show the effect on the reflection coefficients of the ring-slot.
Figure 10:
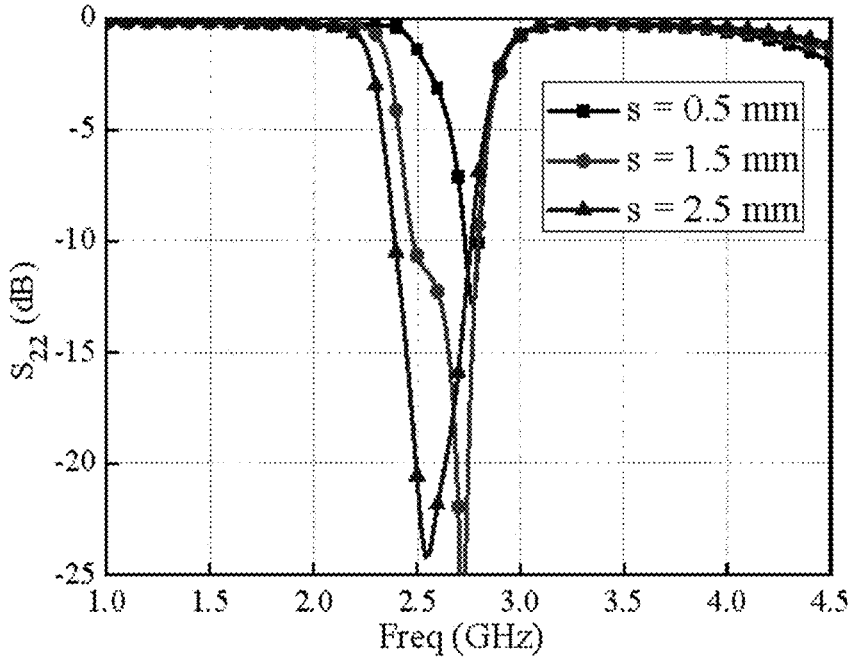

The results for different widths of the ring slot that located between the feeding line and driven patch are shown in FIGS. 10 (*a*)-(*b*). It is found that the reflection coefficients of both ports change significantly with different s. The wider slot provides better antenna matching. However, when s is larger than 2.5 mm, the reflection coefficients for port 2 deteriorates. The optimum bandwidth is obtained at s=2.3 mm. In this case, the passband of LTE (2.49-2.69 GHz) can be covered for both polarizations. It is worth mentioning that it has been found that the parameter s has no significant impact on both the isolation and filtering performance. Therefore they are not shown here.

Figure 11:
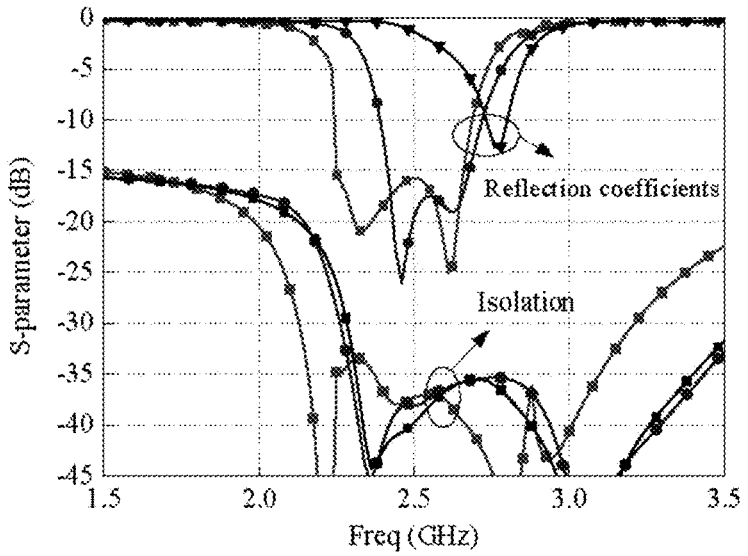
FIG. 11 shows the reflection coefficients and isolation for different bandwidth.

From the point view of filter design, bandwidth control is an important issue because different bandwidths are often required in various wireless systems. For instance, the frequency band 1.92-2.17 GHz is assigned to 3G WCDMA system and the band 2.49-2.69 GHz is assigned to LTE system. Therefore, it would be very desirable if different operating bandwidths can be achieved by a filtering antenna. To demonstrate the flexibly of the proposed design, the dimensions of the feeding lines are tuned to achieve different operating bandwidths. FIG. 11 shows the corresponding simulated S parameters. It can be seen that the −15 dB impedance bandwidth can reach 20%, and the isolation within passband is better than 33 dB. Therefore, the design can be used for different applications.

Based on the above parametric study, a design guideline is recommended as follows. It is assumed that the desired center frequency and wavelength are given by $f_0$ and $\lambda_0$, respectively. 1) Firstly, setting the dimensions of the driven and stacked patches as $p_1=0.4\lambda_0$, $p_2=0.4\lambda_0$, and $h=0.1\lambda_0$. Using a square ground plane with side-length of $G=\lambda_0$.

2) Designing the open feeding lines for the two polarizations, with initial values satisfying equations (1)-(3). Then optimize the line width for better impedance matching.

3) Etching a slot to separate the driven patch and the center feeding line of port 2.

4) Finally, refining each parameter to optimize the design for obtaining good filtering performance and a required bandwidth.

To demonstrate the idea, an antenna for LTE band (2.49-2.69 GHz) is designed and fabricated. In this design, simulated results are obtained by using ANSYS HFSS. Reflection coefficients are measured using an Agilent N5230A network analyzer, while radiation patterns and antenna gains are measured using a Satimo Startlab System.

Figure 12:
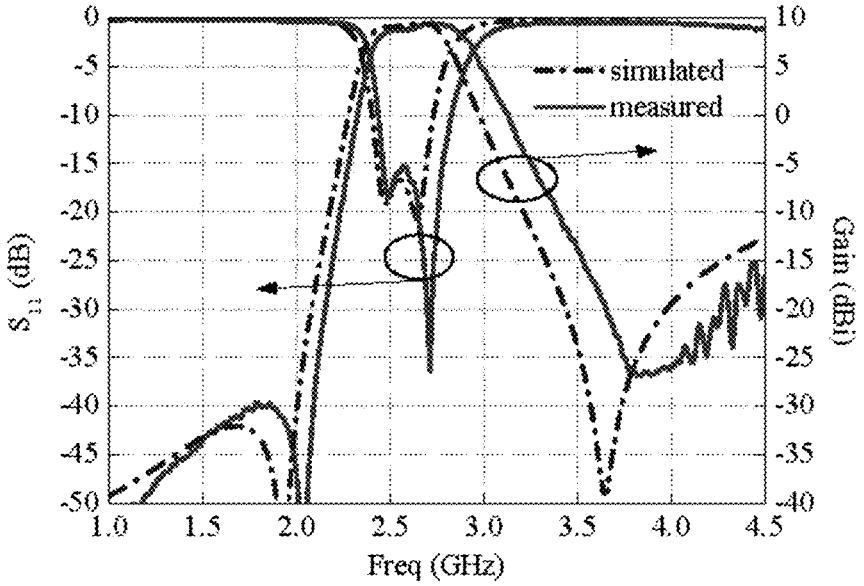
FIGS. 12 (*a*)-(*b*) show the reflection coefficients and gain curves for (a) probe 1; (b) probe 2.
Figure 12:
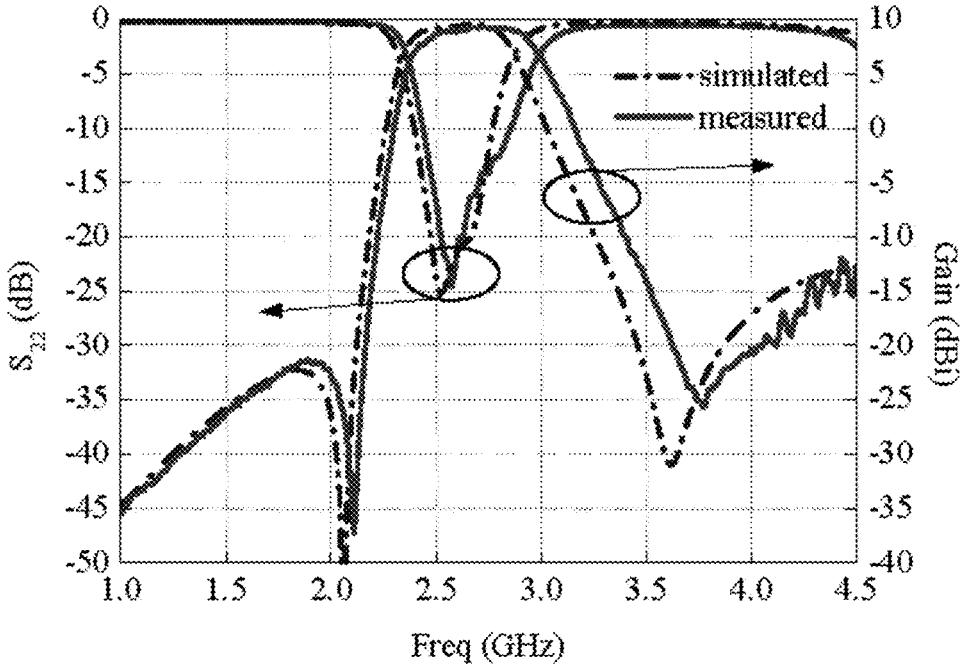
Figure 13:
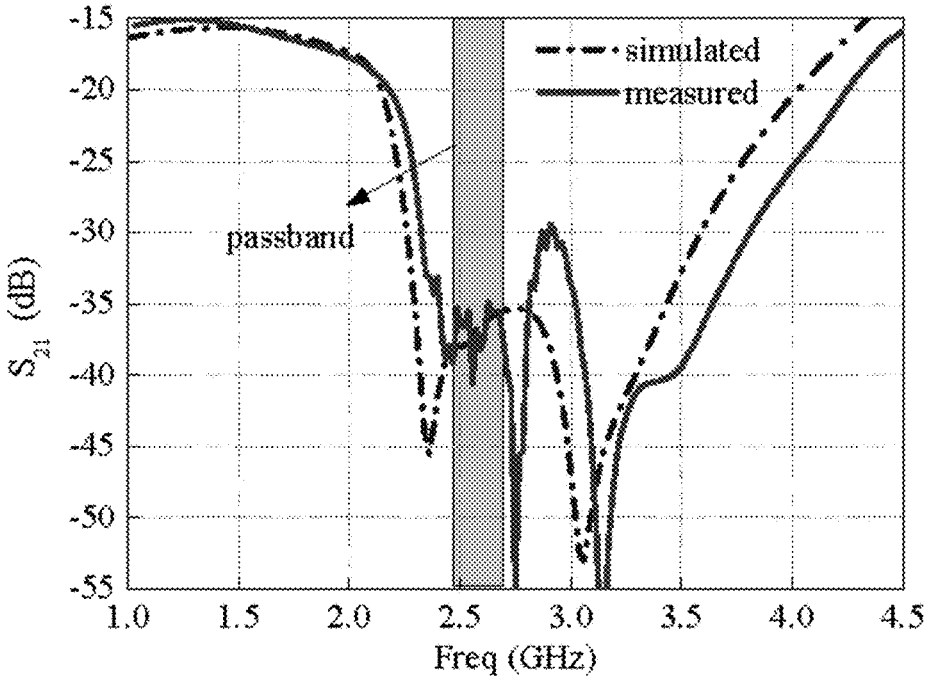
FIG. 13 shows the isolation between two probes.
Figure 14:
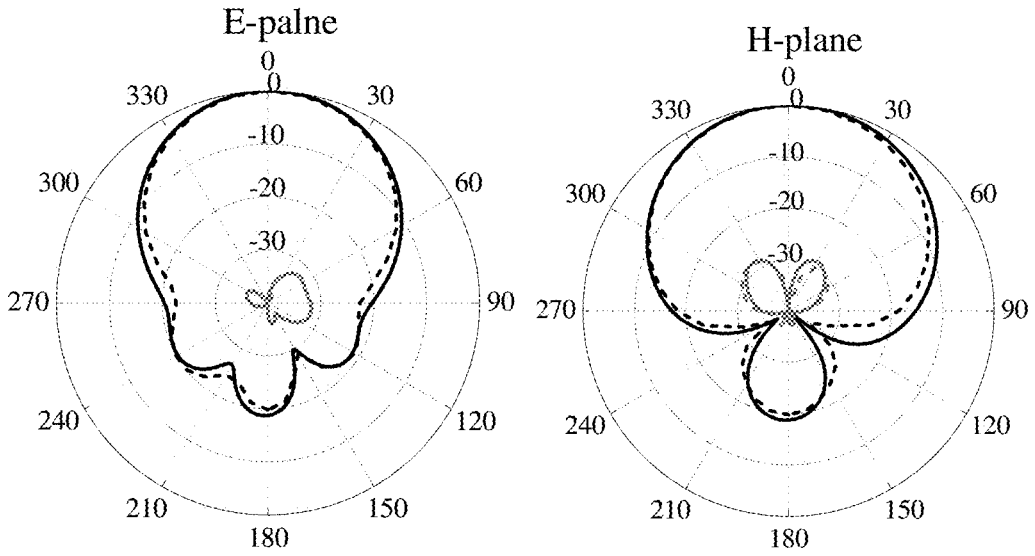
FIGS. 14 (*a*)-(*b*) show the measured and simulated radiation patterns of the dual-polarized filtering antenna at (a) 2.49 and (b) 2.69 GHz for probe 1.
Figure 14:
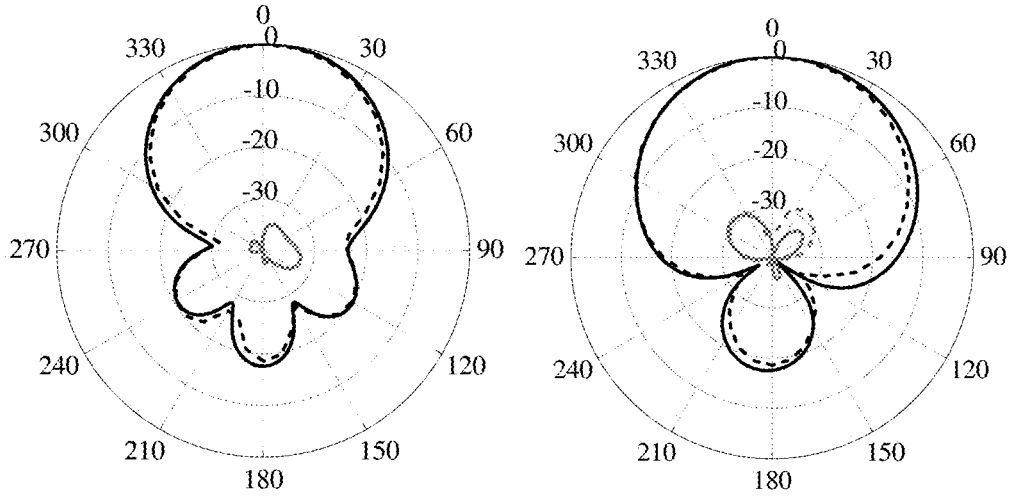
Figure 15:
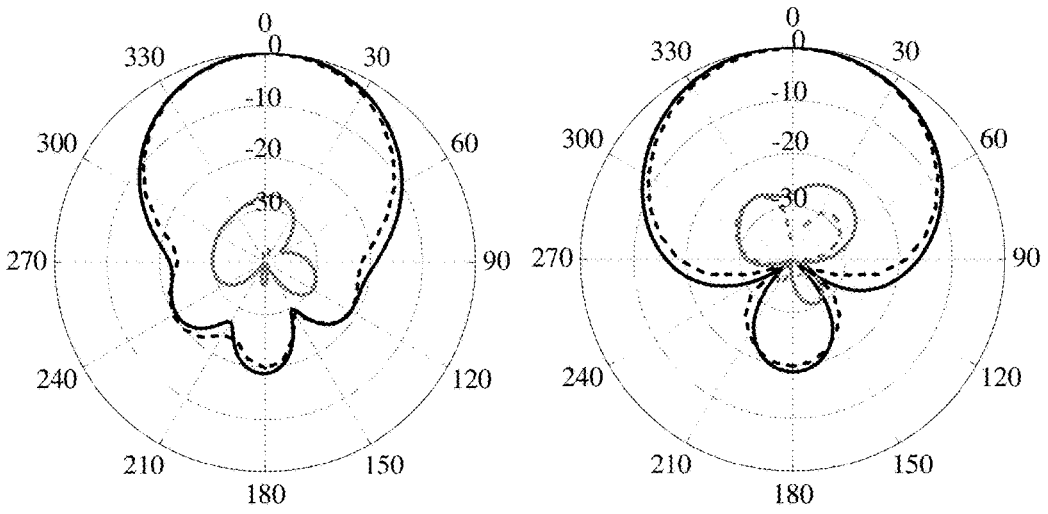
FIGS. 15 (*a*)-(*b*) show the measured and simulated radiation patterns of the dual-polarized filtering antenna at (a) 2.49 and (b) 2.69 GHz for probe 2.
Figure 15:
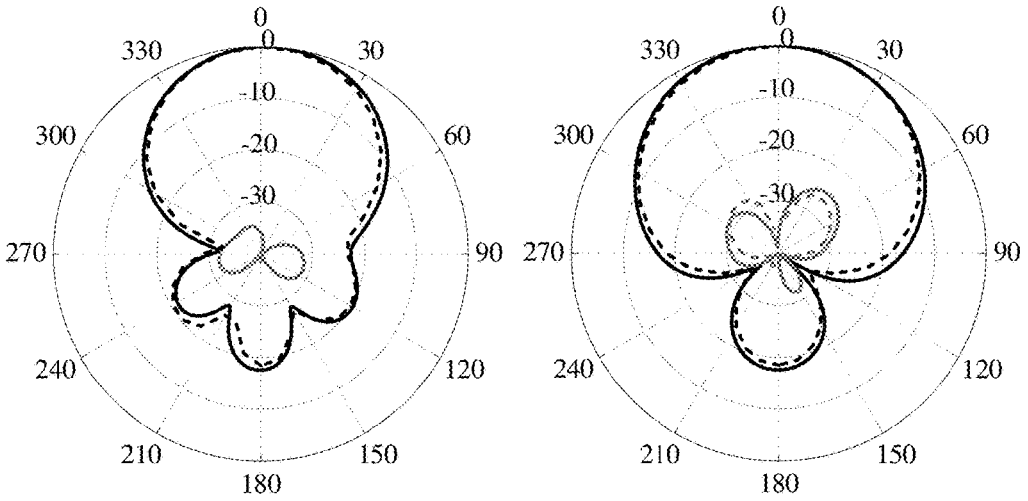

FIGS. 12 (*a*)-(*b*) show simulated and measured reflection coefficients and gains for the two ports of the proposed dual-polarized antenna. It can be seen from FIG. 12(*a*) that the measured impedance bandwidth ($S_{11}$<−15 dB) for Port 1 is given by 12.2% (2.46-2.78 GHz), a bit wider than the simulated value of 10.1% (2.44-2.70 GHz). The small error is mainly due to fabrication tolerance and experimental imperfection. Two resonant modes are observed in the passband, which are generated by the driven patch and the stacked patch. With reference to the gain curves, a quasi-elliptic bandpass response has been achieved. The average gain within passband is ~9 dBi, and the out-of-band suppression level can reach 40 dB in the lower band from 1.71-2.17 GHz. The high suppression can avoid interference with the 2G and 3G systems. High selectivity is obtained by two radiation nulls found at 2.1 GHz and 3.7 GHz, which are due to the feeding line and the stacked patch, respectively. Similar results have been obtained for Port 2, with the measured impedance bandwidth ($S_{22}$<−15 dB) given by 8.2% (2.49-2.70 GHz) and average gain given by 9 dBi. The isolation between two ports is shown in FIG. 13. It can be seen that the mutual coupling between the two ports is lower than −35 dB across the entire impedance passband, which is sufficient for many practical communication applications. FIGS. 14 (*a*)-(*b*) show measured and simulated radiation patterns for Port 1 at 2.49 and 2.69 GHz. As can be observed, stable broadside radiation characteristics are obtained across the entire passband. Due to the coupling feeding scheme and symmetry of the H-shaped feeding line, the measured co-polarized field is at least 29 dB stronger than the cross-polarized counterpart. The measured front-to-back ratio is more than 18 dB. Radiation patterns for Port 2 shown in FIGS. 15 (*a*)-(*b*) are almost the same as those for Port 1.

Accordingly, a novel kind of compact dual-polarized filtering patch antenna with satisfying filtering performance and low cross-polarization has been investigated in the present application. The operating mechanism of the antenna has been studied based on the filter theory. It has been shown that two radiation nulls can be achieved and controlled by the stacked patch and H-shaped feeding line, respectively. They provide high selectivity and high out-of-band suppression levels of more than 40 dB in the lower stopband for each port. Since no extra filtering circuit is involved, the radiation perform an filtering antenna can provide a relatively high gain of ~9 dBi, a low cross polarization of 29 dB, and a high isolation of 35 dB between two ports. It is worth mentioning that the antenna exhibits high out-of-band rejection in the DCS/WCDMA bands, therefore can be used to reduce mutual coupling between antenna elements in multi-band base station antenna arrays for 2G/3G/4G applications.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What claimed is:

1. A dual-polarized filtering antenna comprising a driven patch, a parasitic stacked patch and a feeding network, wherein the parasitic stacked patch is fabricated on a top face of a first substrate, the driven patch and the feeding network are fabricated on top and bottom faces of a second substrate, respectively; wherein the feeding network comprises a first H-shaped feeding line and a second H-shaped feeding line which are orthogonal, wherein the parasitic stacked patch and the driven patch are excited by the first H-shaped feeding line and the second H-shaped feeding line, each for one polarization.

2. The dual-polarized filtering antenna according to claim 1, wherein, a radiation null in a lower band is realized by the first H-shaped feeding line and the second H-shaped feeding line, and another radiation null in an upper band is obtained by the stacked patch.

3. The dual-polarized filtering antenna according to claim 2, wherein, without extra filtering circuit, good bandpass filtering response in a gain curve is obtained by two radiation nulls realized by the first H-shaped feeding line and the second H-shaped feeding line and by the stacked patch, respectively.

4. The dual-polarized filtering antenna according to claim 2, wherein, a frequency of the radiation null generated by the first H-shaped feeding line and the second H-shaped feeding line is controlled by adjusting a size of the first H-shaped feeding line and the second H-shaped feeding line.

5. The dual-polarized filtering antenna according to claim 2, wherein, an equivalent length of the H-shape feeding line is about half of a wavelength at a frequency of the radiation null in the lower band.

6. The dual-polarized filtering antenna according to claim 2, wherein, a frequency of the radiation null generated by the stacked patch is controlled by adjusting a size of the stacked patch.

7. The dual-polarized filtering antenna according to claim 2, wherein, the first H-shaped feeding line and the second H-shaped feeding line are designed as a stepped-impedance line with different widths for better impedance matching.

8. The dual-polarized filtering antenna according to claim 1, wherein, a structure of this dual-polarized filtering antenna is designed symmetrically, a better cross-polarization is obtained.

9. The dual-polarized filtering antenna according to claim 1, wherein, an air gap is introduced between the first and second substrates for enhancing antenna bandwidth and gain.

10. The dual-polarized filtering antenna according to claim 7, wherein, a first probe and a second probe of the first H-shaped feeding line and the second H-shaped feeding line are fed by an inner conductor of SMA connectors at a distance from a center of the first H-shaped feeding line, and a distance from the center of the second H-shaped feeding line, respectively.

11. The dual-polarized filtering antenna according to claim 10, wherein the impedance matching is adjusted by changing the distance between the center of the first H-shaped feeding line and the first probe, and the distance between the center of the second H-shaped feeding line and the second probe.

12. The dual-polarized filtering antenna according to claim 11, wherein, the center part of the second H-shaped feeding line for the second probe is set on the top face of the second substrate, and connected remaining parts of the second H-shaped feeding line via two metallic via holes, the remaining parts of the second H-shaped feeding line is on the bottom face of the second substrate.

13. The dual-polarized filtering antenna according to claim 12, wherein, a ring slot is etched to separate the center part of the second H-shaped feeding line and the driven patch.

14. A dual-polarized filtering antenna comprising a driven patch, a parasitic stacked patch and a feeding network, wherein the parasitic stacked patch is fabricated on a top face of a first substrate, the driven patch and the feeding network are fabricated on top and bottom faces of a second substrate, respectively, an air gap is introduced between the first and second substrates for enhancing antenna bandwidth and gain, the feeding network comprises a first H-shaped transmission line and a second H-shaped transmission line which are orthogonal, wherein the parasitic stacked patch and the driven patch are excited by the first H-shaped transmission line and the second H-shaped transmission line, each for one polarization; wherein the first H-shaped transmission line and the second H-shaped transmission line are designed as a stepped-impedance line with different widths for better impedance matching, a center part of the second H-shaped transmission line for the second probe is set on a top face of the second substrate, and connected remaining parts of the second H-shaped transmission line via two metallic via holes, the remaining parts of the second H-shaped transmission line is on the bottom face of the second substrate; a square ground plane with a size of one wavelength is used for directional radiation of the dual-polarized filtering antenna.

15. The dual-polarized filtering antenna according to claim 14, wherein, a ring slot is etched to separate the center part of the second H-shaped feeding line and the driven patch.

16. The dual-polarized filtering antenna according to claim 15, wherein, a first probe and a second probe of the first H-shaped transmission line and the second H-shaped transmission line are fed by an inner conductor of SMA connectors at a distance from a center of the first H-shaped feeding line, and a distance from the center of the second H-shaped feeding line, respectively.

17. A dual-polarized filtering antenna comprising a driven patch, a parasitic stacked patch and a feeding network, wherein the parasitic stacked patch is fabricated on a top face of a first substrate, the driven patch and the feeding network are fabricated on top and bottom faces of a second substrate, respectively; an air gap is introduced between the first and second substrates for enhancing antenna bandwidth and gain; the feeding network comprises a first H-shaped feeding line and a second H-shaped feeding line which are orthogonal, wherein the parasitic stacked patch and the driven patch are excited by the first H-shaped feeding line and the second H-shaped feeding line, each for one polarization, wherein the first H-shaped feeding line and the second H-shaped feeding line are designed as a stepped-impedance line with different widths for better impedance matching, a center part of the second H-shaped feeding line for the second probe is set on a top face of the second substrate, and connected remaining parts of the second H-shaped feeding line via two metallic via holes.

18. The dual-polarized filtering antenna according to claim 17, wherein, a ring slot is etched to separate the center part of the second H-shaped feeding line and the driven patch.

19. The dual-polarized filtering antenna according to claim 18, wherein a first probe and a second probe of the first H-shaped transmission line and the second H-shaped transmission line are fed by an inner conductor of SMA connectors at a distance from a center of the first H-shaped feeding line, and a distance from the center of the second H-shaped feeding line, respectively.

* * * * *